United States Patent [19]

Cleary et al.

[11] 3,991,700

[45] Nov. 16, 1976

[54] RUDDER ATTACHMENT FOR OUTBOARD MOTORS

[76] Inventors: William T. Cleary, 209 Fisher St.; Paul A. Bourgeois, 1126 N. Front St., both of Marquette, Mich. 49855

[22] Filed: Aug. 21, 1975

[21] Appl. No.: 606,658

[52] U.S. Cl. ..... 115/18 B

[51] Int. Cl.[2] ..... B63H 25/06

[58] Field of Search..... 115/18 B; 114/165, 145 A, 114/162

[56] References Cited

UNITED STATES PATENTS

| | | | |
|---|---|---|---|
| 1,118,011 | 11/1914 | Hult et al. | 115/18 B |
| 2,654,336 | 10/1953 | Katzung et al. | 114/145 A |
| 2,956,533 | 10/1960 | De Yo | 115/18 B |
| 3,435,799 | 4/1969 | Linsley | 115/18 B |
| 3,516,378 | 6/1970 | Linsley | 115/18 B |
| 3,939,792 | 2/1976 | Wasenius | 114/162 |

FOREIGN PATENTS OR APPLICATIONS

| | | | |
|---|---|---|---|
| 1,005,565 | 9/1965 | United Kingdom | 115/18 B |

*Primary Examiner*—Trygve M. Blix
*Assistant Examiner*—Stuart M. Goldstein
*Attorney, Agent, or Firm*—Whittemore, Hulbert & Belknap

[57] ABSTRACT

A rudder attachment for outboard motors comprising an upright blade or rudder adapted to be removably attached to the gear case or lower end assembly of the motor behind the propeller. The attaching members comprises, in one embodiment, flexible metal straps adapted to be secured together about opposite sides of the gear case and, in another embodiment, metal strips adapted to be secured to the cavitation plate and metal brackets connecting the rudder to the strips.

1 Claim, 4 Drawing Figures

RUDDER ATTACHMENT FOR OUTBOARD MOTORS

BACKGROUND AND SUMMARY OF THE INVENTION

The rudder attachment of this invention will fit all makes of trolling outboard motors and is provided primarily for the purpose of maintaining a true course without having to adjust course every few minutes. It allows a lone fisherman in a boat to troll without being required to keep a constant hand on the steering arm. Thus one man in the boat will have more time to fish and be required to spend less time steering and keeping on course. The rudder attachment helps to maintain a given direction through rough water and stiff wind. The rudder attachment also helps to avoid getting the fishing lines caught in the propeller when turning in shallow water.

Rudder attachments for outboard motors in the past have been too complicated and too cumbersome. The rudder attachment of the present invention is composed of a few simple parts and may be readily attached to and removed from the outboard motor. It is at the same time inexpensive to make and is well suited to the accomplishment of its intended function.

Figure 1:
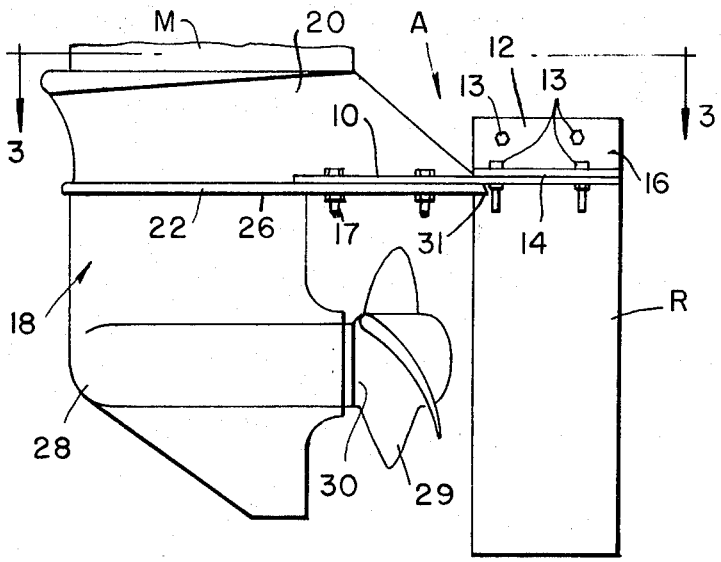
FIG. 1 is a side elevational view of the lower portion of an outboard motor having the rudder attachment of our invention secured thereto.
Figure 2:
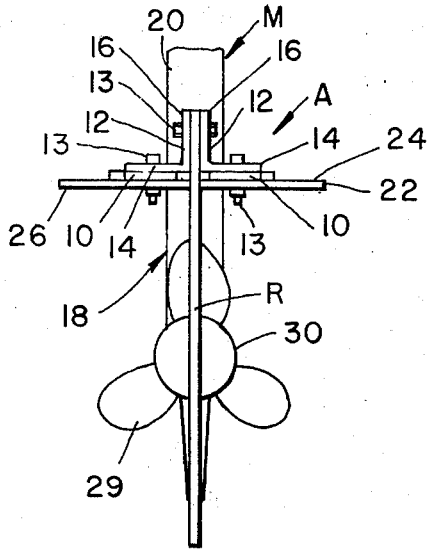
FIG. 2 is a view of the structure shown in FIG. 1 as seen from the right.
Figure 3:
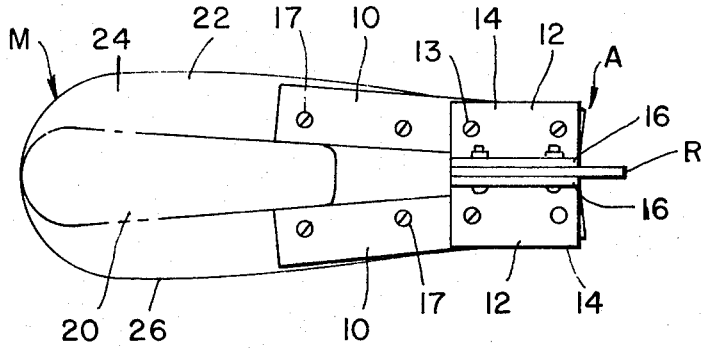
FIG. 3 is a view taken along the line 3—3 in FIG. 1 looking down on the rudder attachment.

Referring now more particularly to the drawing and especially to FIGS. 1 to 3 thereof, the rudder attachment A comprises a blade or rudder R which is in the form of an elongated rectangular piece of metal sheet or plate, preferably aluminum, of a thickness and quality sufficient to have the required rigidity. It is secured to the outboard motor M in an upright position behind the propeller by mounting means of flat strip stock in this instance comprising the two bars or strips 10 and the two brackets 12. The strips 10 are formed of metal, preferably aluminum, and are elongated members of sufficient thickness to be fairly rigid and to support the rudder R in a firm and rigid condition. The brackets 12 may be of the same thickness and material as the strips 10 and are right angle members having the flanges 14 and 16.

The outboard motor M is of a more or less conventional construction common to all outboard motors, having a gear case or lower end assembly 18 which constitutes a combined rudder, propeller shaft support and gear housing, underwater exhaust, and cooling water intake. Only this gear case or lower end assembly of the motor is shown. The upper part 20 of the gear case has the configuration in horizontal section shown in FIG. 3, being rounded at the front end and having opposite sides narrowing and flattening toward the rear.

A cavitation plate 22 projects horizontally outwardly from front to rear of the part 20 of the gear case having the portions 24 and 26 along opposite sides of the part 20.

Below the cavitation plate, the gear case has a downwardly extending projection 28 providing a housing for the propeller shaft, not shown, its bearings and beveled gears. The propeller 29 has its hub 30 bearing against the rear face of the housing. This gear case is not well shaped to produce a good rudder effect since the propeller itself must be turned to steer the boat.

According to the present invention, the rudder attachment A is located so that the rudder R is directly behind the propeller in upright position in the slip stream of the propeller. The rudder may have a notch 31 to receive a projection on the gear case and provide greater stability and rigidity in the support of the rudder if desired. The vertical flanges 16 of the two brackets 12 are disposed upon opposite sides of the upper end portion of the rudder blade R in surface-to-surface relation therewith and have matching holes which are aligned with corresponding holes in the upper portion of the rudder. Fasteners 13 here shown as being in the form of nut and bolt assemblies extend through the aligned openings to removably secure the bracket flanges 16 to the rudder.

The horizontal flanges 14 of the brackets 12 overlie the rear end portions of the strips 10 in surface-to-surface relation and are removably secured thereto by nut and bolt assemblies 13 extending through matched or aligned openings in the flanges 14 and in the strips 10. The forwardly extending portions of the strips 10 rest in surface-to-surface relation upon the upper surfaces of the two portions 24 and 26 of the cavitation plate 22 on opposite sides of the housing and are removably secured thereto by nut and bolt assemblies 17 extending through aligned openings therein.

It will be seen that the rudder R is firmly and securely yet removably attached to the cavitation plate 22 in an upright position directly behind the propeller so as to be disposed in the propeller slip stream and thereby serve to steady and guide the course of the motor boat. Obviously, the rudder attachment may be readily removed from the motor simply by removing the appropriate fasteners, and in fact the mounting means for the rudder may be separated into individual parts and removed from the rudder likewise by detaching the fasteners. It will be understood that adjustment of the rudder may be easily accomplished simply by drilling alternate sets of holes in the rudder, and likewise the mounting of the attachment on the cavitation plate may be easily adjusted by drilling alternate holes in different positions in the cavitation plate.

Figure 4:
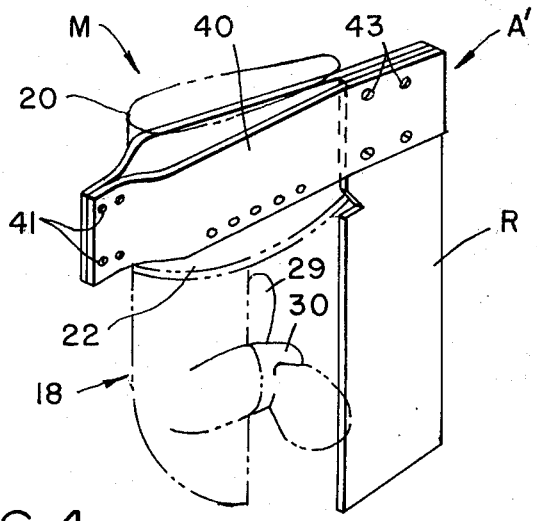
FIG. 4 is a perspective view showing a modification.

FIG. 4 shows a modification of the invention in which the rudder R is the same but the attaching means is different. The attaching means, while still of flat strip stock, comprises a pair of elongated metal straps 40 of aluminum or the like which are preferably thinner than the strips 10 previously described so as to be somewhat flexible and capable of being contoured to fit the configuration of the part 20 of the gear case 18 of the motor. As seen in FIG. 4, these straps 40 rest on the cavitation plate 22 and lie flat against opposite sides of the part 20 of the gear case 18 and have their front ends continued beyond the rounded front nose of the gear case lying flat against one another. Thus there is a full surface-to-surface contact between the straps 40 and the motor part 20 throughout substantially the full length of the straps. The front end portions of the straps in contact with one another are secured together by suitable fasteners 41 extending through holes therein.

The rear projecting ends of the straps 40 which extend beyond the rear of the gear case 18 are disposed in surface-to-surface relation against opposite sides of the upper end portion of the rudder R and are removably secured thereto by suitable nut and bolt assemblies 43 extending through aligned openings therein. The notch 31 in the rudder R is for the purpose of receiving a rearward projection on the gear case, if greater rigidity of support is desired.

The attachment in FIG. 4 is a rigid attachment despite the somewhat flexible nature of the straps 40. The flexibility of these straps is of course in a direction at right angles to the plane of the opposite side surfaces of the straps. There is virtually no edgewise flexibility as will be apparent so that a very stiff and secure mounting for the rudder R is provided. Only a short rearwardly projecting portion of the straps is secured to the rudder R so that the rudder is rigidly supported. The rudder attachment may be easily removed from the motor and from the rudder as well, if desired, by removing the appropriate fasteners. Because of the flexible nature of the straps 40, they may be readily applied in surface-to-surface relation to the part 20 of the gear case of outboard motors having different configurations. By drilling alternate holes in the rudder R, its position may be adjusted as desired.

What we claim as our invention is:

1. A rudder attachment for an outboard motor, which outboard motor has a gear case carrying a propeller and a horizontal cavitation plate above the propeller, said rudder attachment comprising a rudder, and means for mounting said rudder in upright position behind the propeller, said mounting means consisting of two identical elongated horizontal metal strips, two identical right angle brackets and fasteners, said elongated horizontal metal strips being fixedly removably secured by certain of said fasteners in surface-to-surface relation to said cavitation plate, said strips having rearwardly projecting portions extending beyond said cavitation plate, and said angle brackets having horizontal flanges fixedly removably secured in surface-to-surface relation by certain of said fasteners to said rearwardly projecting portions of said metal strips and upright flanges fixedly removably secured by certain of said fasteners in surface-to-surface relation to opposite sides of the upper portion of said rudder.

* * * * *